US005945624A

United States Patent [19]

Becker et al.

[11] Patent Number: 5,945,624

[45] Date of Patent: Aug. 31, 1999

[54] AMMUNITION MAGAZINE FOR LARGE-CALIBER AMMUNITION

[75] Inventors: Wilfried Becker; Hans-Ulrich Desgranges, both of Celle; Heinz Haas, Suderburg; Uwe Eisenkolb, Lüneburg, all of Germany

[73] Assignee: Rheinmetall W&M GmbH, Unterluss, Germany

[21] Appl. No.: 09/145,298

[22] Filed: Sep. 2, 1998

[30] Foreign Application Priority Data

Sep. 3, 1997 [DE] Germany ..... 197 38 418

[51] Int. Cl.[6] ..... F41A 9/34

[52] U.S. Cl. ..... 89/33.14; 89/34; 89/1.59

[58] Field of Search ..... 89/34, 33.14, 1.53, 89/1.58, 1.59

[56] References Cited

U.S. PATENT DOCUMENTS 3,501,996 3/1970 Lipp et al. ..... 89/34

4,876,940 10/1989 Aloi et al. ..... 89/34

5,131,315 7/1992 Mahev et al. ..... 89/34

FOREIGN PATENT DOCUMENTS 18872 12/1933 Poland .

*Primary Examiner*—Stephen M. Johnson

*Attorney, Agent, or Firm*—Venable; Norman N. Kunitz

[57] ABSTRACT

In order to accommodate the ammunition (7) in an ammunition magazine (1) in a space- and mass-saving manner without an external drive, and to subsequently remove the ammunition quickly from the magazine, the individual ammunition bodies (7) are disposed, with the aid of holders (10), on the chain links (8, 9) of a rigid-backed chain (6) (ammunition chain) seated to be displaced in two rails (3, 4). In such an arrangement, the ammunition (7) can be removed quickly from the magazine (1) through the withdrawal of the chain (6) and the pivoting of the individual chain links (8, 9) toward the rear side (15) of the chain (6), and stowed again when the chain (6) is pushed back into the magazine frame.

5 Claims, 3 Drawing Sheets

AMMUNITION MAGAZINE FOR LARGE-CALIBER AMMUNITION

REFERENCE TO RELATED APPLICATIONS

This application claims the priority of German application Serial No. DE 197 38 418.8, filed Sep. 3, 1997, which is incorporated herein by reference.

BACKGROUND OF THE INVENTION

The invention relates to an ammunition magazine for large-caliber ammunition.

To accommodate ammunition inside an armored carrier vehicle equipped with a gun, it is known to store the ammunition in endless chains and transport it to a corresponding removal of extraction site by means of an external drive. Among the disadvantages of such magazines with an external drive is that they have a relatively complex design, possess a large mass and require additional energy.

Also known are ammunition magazines in which the ammunition is stored in stowage containers having tubes. One of the disadvantages of these types of magazines is that access to the individual ammunition bodies is relatively time-consuming. In particular, to ensure a high firing speed, a specific number of ammunition bodies must be able to be removed as quickly as possible from the magazine, made ready with respect to the fuse setting and the quantity of propellant, and subsequently stowed safely in the magazine again until they are fired.

It is the object of the present invention to provide an ammunition magazine that has no external drive, and which permits a space- and mass-saving storage and quick removal of the ammunition.

SUMMARY OF THE INVENTION

This object is accomplished by an ammunition magazine for large-caliber ammunition which includes at least one rigid-backed ammunition chain comprised of individual chain links, with the individual chain links being disposed to pivot toward the rear side of the chain by means of corresponding hinges between adjacent links for removal of the ammunition; a magazine frame having at least one and preferably two rails disposed therein and on which the ammunition chain is disposed to be displaced in the direction of the longitudinal axis of the magazine; and, at least one holding arm of an ammunition holder disposed on the front side of each chain link, with the respective arms of two adjacent chain links being adjacent and facing each other such that the two holding arms together hold a respective ammunition body when the adjacent chain links are both seated on the rail. Further, advantageous embodiments and modifications of the invention are disclosed.

The essential concept of the invention is to arrange the individual ammunition bodies, with the aid of holders, on the links of a chain that has a rigid back (ammunition chain) and is seated to be displaced in at least one and preferably two rails. In this type of arrangement, the ammunition can be removed quickly from the magazine through the withdrawal of the chain and pivoting of the individual links toward the rear side of the chain, and the ammunition can be stowed again when the chain is pushed back.

The magazine is preferably designed to encompass a plurality of superposed ammunition chains.

The invention has the following advantages:

The individual ammunition bodies are reliably positioned on the ammunition chain with the aid of holders, and are first released from the chain in the removal process.

Because all of the ammunition bodies are directly accessible, simultaneous access to different types of ammunition is possible.

The ammunition chain has a small structural height and depth. Consequently, the packing volume of the ammunition and the magazine weight are low.

Because the ammunition chain bends toward the rear side of the chain, only a small amount of space is required in front of the magazine for removing the ammunition.

Further details and advantages of the invention ensue from the following embodiments explained in conjunction with figures.

DETAILED DESCRIPTION OF THE PREFERRED EMBODIMENTS

Figure 1:
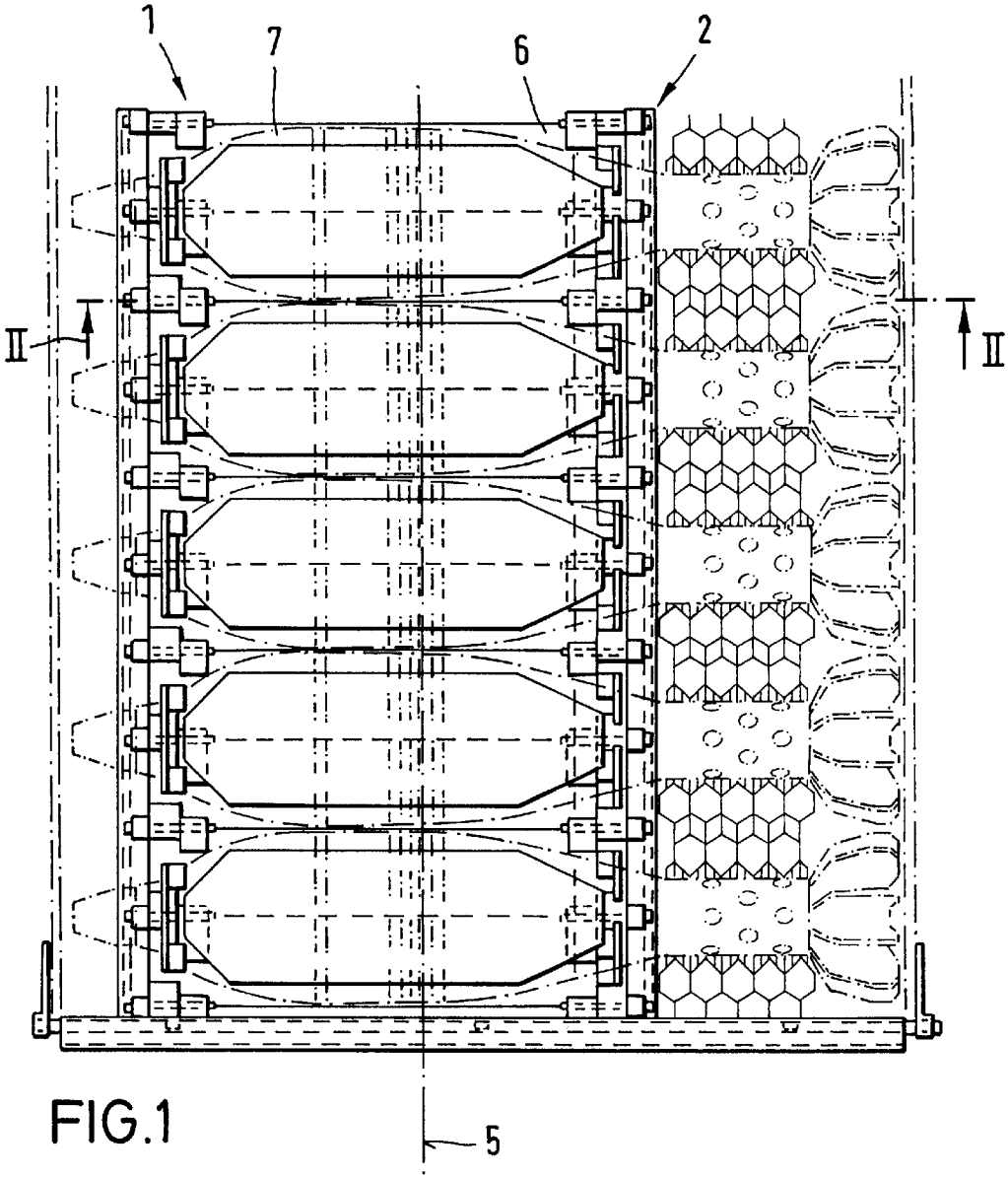
FIG. 1 shows a plan view of an ammunition magazine according to the invention having an ammunition chain with five ammunition bodies, the chain being disposed in an ammunition magazine frame.
Figure 2:
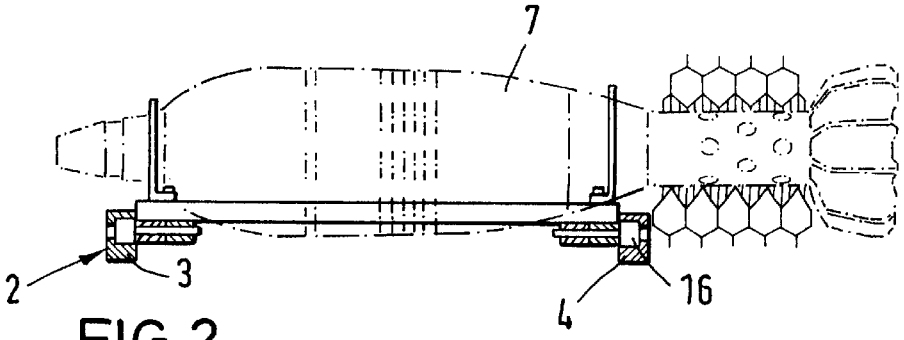
FIG. 2 shows a section along the line indicated by II—II in FIG. 1.

FIG. 1 shows an ammunition magazine 1 for mortar ammunition, which is disposed in an armored carrier vehicle of a grenade launcher, for example, not shown in order to give a clear overview.

Ammunition magazine 1 includes a magazine frame 2 and an ammunition chain 6 that has a rigid back and is disposed to be displaced horizontally in the direction of the longitudinal axis 5 of the frame 2 on two substantially parallel rails 3, 4 disposed within frame 2. The ammunition bodies 7 lie on the chain links 8, 9 of ammunition chain 6, and are fixed in their position there by ammunition holders 10. Each holder 10 comprises two curved holding arms 11, 12, which surround the respective ammunition body 7, with each of the two holding arms 11, 12 which form a respective holder 10 being disposed on the top surface 13 of adjacent chain links 8, 9 (FIG. 9) of respectively adjacent facing ends of the respective chain links 8, 9. As shown each chain link 8, 9 has one of the curved arms 11, 12 on its front surface.

Ammunition chain 6 is a link chain in which the links 8, 9 are joined by hinges 14 located near the bottom of the respective links so that the links can only pivot out of the extended state of the chain 6 toward the rear side 15 of chain 6. Rollers 16 are mounted on the hinge pins of the hinges 14 between the chain links 8, 9. These rollers 16 run in the two rails 3, 4 of the magazine frame 2, and permit a largely frictionless withdrawal and insertion of ammunition chain 6 from and into magazine frame 2, respectively, provided that a closing flap 17 disposed at an end of the magazine frame is opened in advance.

Moreover, ammunition chain 6 includes an extraction block 18 adjacent to the back end which engages the frame 2 for preventing a complete withdrawal of the chain from magazine frame 2.

Figure 3:
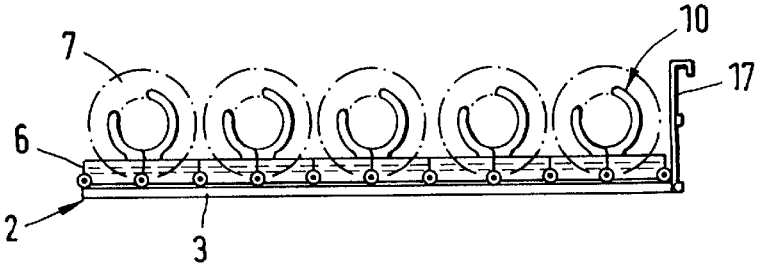
FIGS. 3–9 show front views of the ammunition magazine shown in FIG. 1, with the ammunition chain being withdrawn to different distances from the magazine frame.
Figure 4:
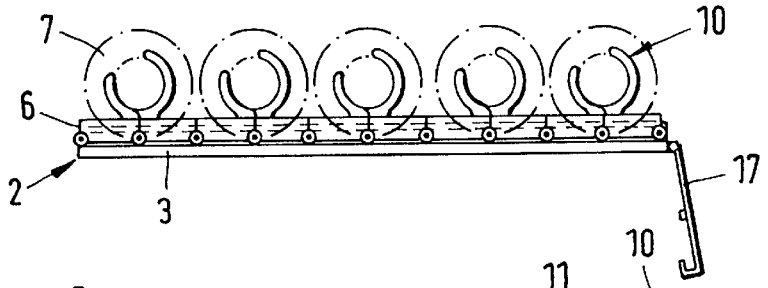
Figure 5:
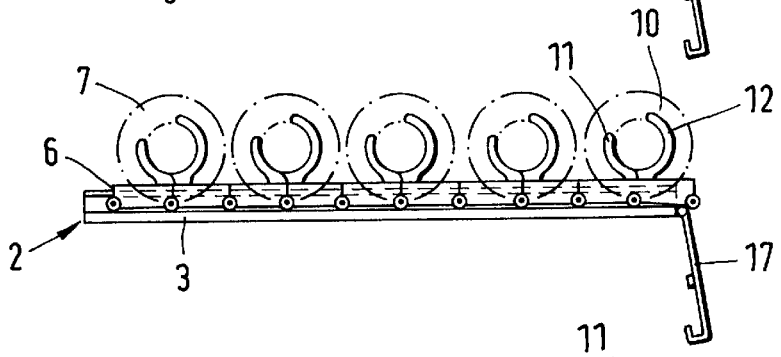
Figure 6:
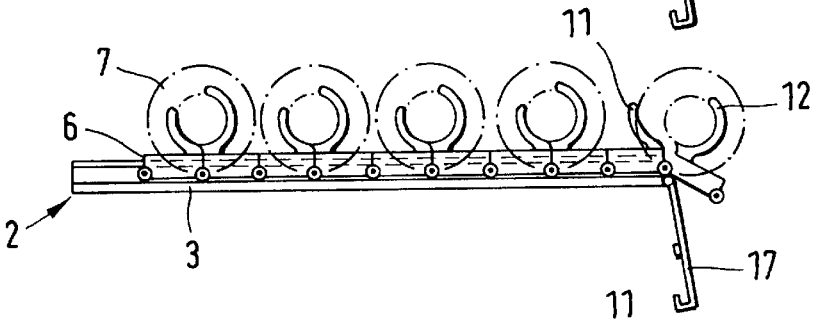
Figure 7:
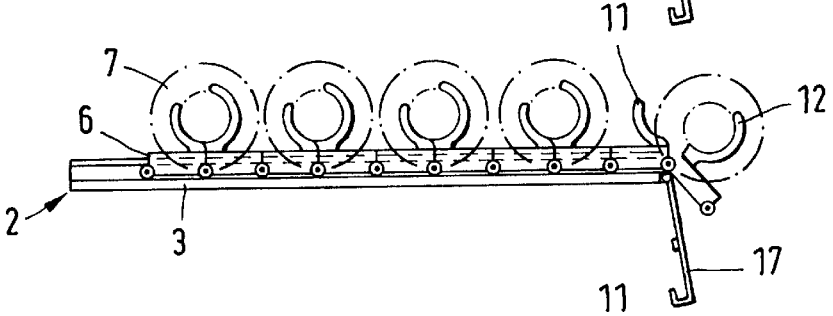
Figure 8:
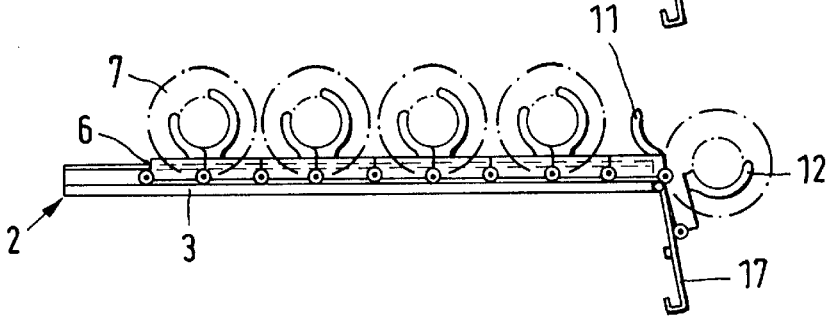

The function of ammunition chain 6 is described in detail below with reference to FIGS. 3–9:

For transporting ammunition body 7, ammunition chain 6 is completely inserted into ammunition frame 2 and closing flap 17 is closed (FIG. 3). To remove the ammunition, closing flap 17 is opened (FIG. 4) and ammunition chain 6 is pulled laterally out of magazine frame 2 (FIG. 5). As ammunition chain 6 is drawn further out of magazine frame 2, the rigid-backed chain 6 folds downward (FIGS. 6, 7), and the arms 11 and 12 of the corresponding ammunition holder 10 at the entrance of the magazine opens and releases the respective ammunition body 7 for removal (FIG. 8).

Figure 9:
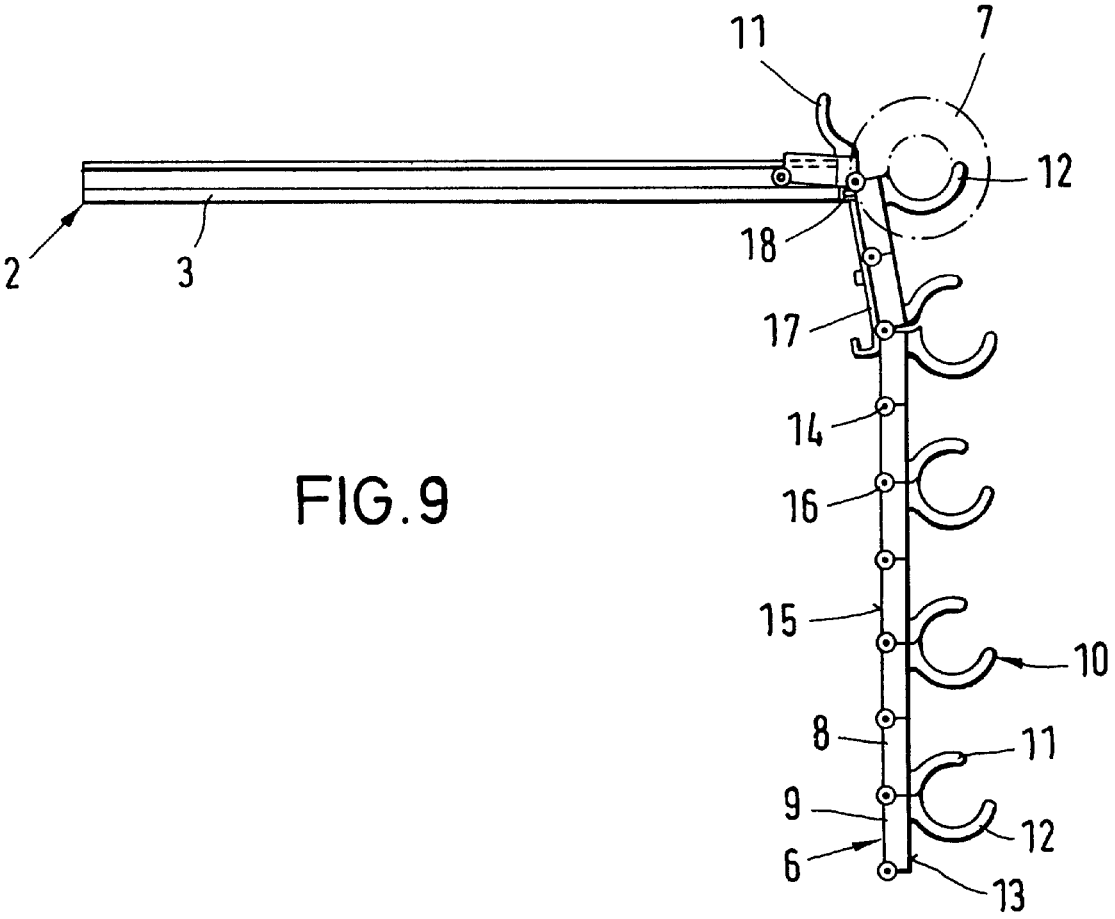

This procedure can be continued until extraction block 18 engages the frame 2 and prevents the ammunition chain 6 from being pulled out further, and the last ammunition body 7 can be removed from chain 6 (FIG. 9).

To reload ammunition bodies 7 into magazine 1, ammunition bodies 7 are placed onto the arms 12 of respective ammunition holders 10 while ammunition chain 6 is out of the magazine as shown, e.g., in FIG. 9. Then the ammunition chain 6, is folded or pivoted upward link by link into the plane of the rails 3, 4 and then pushed back into magazine frame 2.

This causes the arms of the holder 10 at the entrance of the magazine frame 2 to pivot about the pivot axis of hinge 14 and close the associated holder 10 around the respective ammunition body 7.

Of course, the invention is not limited to the described embodiment. For example, the ammunition magazine 2 can also include a plurality of superposed ammunition chains 6 mounted on respective rails 3,4 instead of only one ammunition chain.

The invention now being fully described, it will be apparent to one of ordinary skill in the art that any changes and modifications can be made thereto without departing from the spirit or scope of the invention as set forth herein.

We claim:

1. An ammunition magazine comprising:

at least one of rigid-backed ammunition chain having first and second ends and comprising individual chain links having first and second opposite sides, with the individual chain links being connected with one another via hinges to pivot only toward the a first side of the chain;

a magazine frame having at least one horizontal rail disposed therein and extending in a direction of a longitudinal axis of the magazine frame from a rear end to a front open end of the frame, with the ammunition chain being disposed on the rail, with its first side facing the rail and with its first and second ends adjacent the respective front and rear ends of the frame, to be horizontally displaced in the direction of the longitudinal axis of the magazine frame; and, at least one holding arm of an ammunition holder is disposed on the second side of each chain link at an end adjacent and facing a holding arm of an adjacent chain link, with the arm being embodied such that two facing holding arms of adjacent links together hold a respective ammunition body, when the adjacent chain links are both seated on the rail.

2. An ammunition magazine as defined in claim 1, wherein the magazine frame includes two substantially parallel rails on which the chain is disposed for movement.

3. The ammunition magazine as defined in claim 2, further comprising:

rollers, that support the ammunition chain on the rails of the magazine frame, disposed on the first side of the respective chain links.

4. The ammunition magazine as defined in claim 2, wherein a closing flap is disposed at the open end of the magazine frame such that the ammunition chain can only be withdrawn from the magazine frame when the closing flap is open.

5. The ammunition magazine as defined in claim 2, further comprising an extraction block disposed on the ammunition chain adjacent said second end thereof for engaging the magazine frame to prevent a complete withdrawal of the chain from the rails.

* * * * *